US010533342B2

(12) United States Patent
Spencer et al.

(10) Patent No.: US 10,533,342 B2
(45) Date of Patent: Jan. 14, 2020

(54) HANDLES WITH RETRACTED AND EXTENDED POSITIONS

(71) Applicant: Hewlett Packard Enterprise Development LP, Houston, TX (US)

(72) Inventors: Stephen Spencer, Houston, TX (US); Kevin Peter Bold, Houston, TX (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 436 days.

(21) Appl. No.: 15/246,600

(22) Filed: Aug. 25, 2016

(65) Prior Publication Data

US 2018/0058095 A1 Mar. 1, 2018

(51) Int. Cl.

| | |
|---|---|
| ***E05B 5/02*** | (2006.01) |
| ***E05B 1/00*** | (2006.01) |
| ***E05B 3/06*** | (2006.01) |

(52) U.S. Cl.

CPC ..... *E05B 5/003* (2013.01); *E05B 1/0007* (2013.01); *E05B 3/06* (2013.01)

(58) Field of Classification Search

CPC . Y10T 292/57; Y10T 70/5761; Y10T 292/82; Y10T 292/85; Y10T 16/44; Y10T 16/458; Y10T 16/4636; E05B 5/003; E05B 5/00; E05B 85/103; E05B 85/107; E05B 1/00; E05B 1/0038; Y10S 292/31; Y10S 292/37; Y10S 292/30; E05C 1/14; E05C 19/022; E05C 1/065

USPC ..... 292/336.3, 347, 348, 350, 351, 358, 355

See application file for complete search history.

(56) References Cited

U.S. PATENT DOCUMENTS

| | | | | |
|---|---|---|---|---|
| 3,210,976 | A | 10/1965 | Best | |
| 3,299,678 | A * | 1/1967 | Spencer | E05B 5/003 292/251 |
| 4,760,721 | A * | 8/1988 | Steinbach | E05B 5/003 292/212 |
| 4,993,247 | A * | 2/1991 | Minemura | E05B 5/003 292/251 |
| 5,038,588 | A * | 8/1991 | Hall | E05B 5/003 70/208 |
| 5,272,894 | A * | 12/1993 | Stillwagon | E05B 63/121 292/251 |
| 6,193,301 | B1 * | 2/2001 | Baumeier | B60J 7/1851 292/DIG. 4 |
| 7,156,683 | B2 | 1/2007 | Gupta et al. | |
| 7,258,374 | B2 | 8/2007 | Rusiana | |
| 7,695,031 | B2 | 4/2010 | Jackson, Jr. et al. | |
| 7,918,111 | B2 * | 4/2011 | Uliano | E05B 67/36 70/2 |
| 8,291,732 | B2 * | 10/2012 | Ramsauer | E05B 1/0092 292/32 |
| 2014/0331722 | A1 * | 11/2014 | Bridgewater | E05C 5/02 70/57 |

* cited by examiner

*Primary Examiner* — Mark A Williams

(74) *Attorney, Agent, or Firm* — Hewlett Packard Enterprise Patent Department

(57) ABSTRACT

Examples described herein include handles with extended and retracted positions. In some examples, a handle comprises a housing and a knob. The knob may have a first surface and a circumferential sidewall. The knob may have a retracted position in the housing and an extended position. In the extended position, the circumferential sidewall protrudes from the housing and the knob is rotatable between a first position and a second position.

8 Claims, 10 Drawing Sheets

HANDLES WITH RETRACTED AND EXTENDED POSITIONS

BACKGROUND

Data centers may be vulnerable to physical security attacks. For example, a rack server that is not secure may be accessed by unauthorized personnel. Thus, data centers may rely on precautions such as locks to mitigate these physical security attacks.

BRIEF DESCRIPTION OF THE DRAWINGS

The following detailed description references the drawings, wherein.

DETAILED DESCRIPTION

The security of a data center contributes to the overall integrity of the data handled by the data center. Thus, security measures such as lockable handles may be used to prevent physical access of the data center to unauthorized personnel. In some examples, locks are provided on the room that stores the server racks and on the individual racks.

The need for space in a data center is ever increasing due to increased reliance on digital technology. Locks and handles on a server rack may detract from this premium real estate. For example, the protrusion of a handle into the space between racks may leave less room for data center expansion (e.g., the addition of extra servers, switches, etc.). Thus, a handle that has a slim profile may be desirable for racks because slim profile handles allow for more data center expansion room.

Examples disclosed herein address these issues by providing a handle that is retractable into and extendable from a housing. To extend the handle from its retracted position, the handle may be depressed further into the housing. The further depression allows the handle to move from the retracted position to its extended position. In the extended position, the handle may be rotated to operate the door. In the extended position, the handle is not retractable back into the housing. Thus, examples disclosed herein allow for a handle that has a slim profile while not in operational use.

In some examples, a handle comprises a housing and a knob. The knob comprises a first surface and a circumferential sidewall. The knob has a retracted position in the housing and an extended position. In the extended position, the circumferential sidewall protrudes from the housing. Additionally, in the extended position, the knob is rotatable between a first position and a second position.

In some examples, a door comprises a housing with an opening, a push-push latch mounted inside the opening, and a circular knob with an arm to engage the push-push latch. The arm engages the push-push latch to retain the circular knob in a retracted position in the opening. The arm disengages the push-push latch to release the circular knob from the retracted position to an extended position. In the extended position, the circular knob is rotatable between a locked position and an unlocked position.

In some examples, a computing device rack handle comprises a rectangular panel with an opening and a circular knob. The circular knob comprises a first surface and a sidewall connected to the first surface. The circular knob comprises a retracted position and an extended position. In the retracted position, the sidewall is recessed into the opening. In the extended position, the sidewall protrudes from the opening and the circular knob is rotatable between a locked position and an unlocked position.

Figure 1:
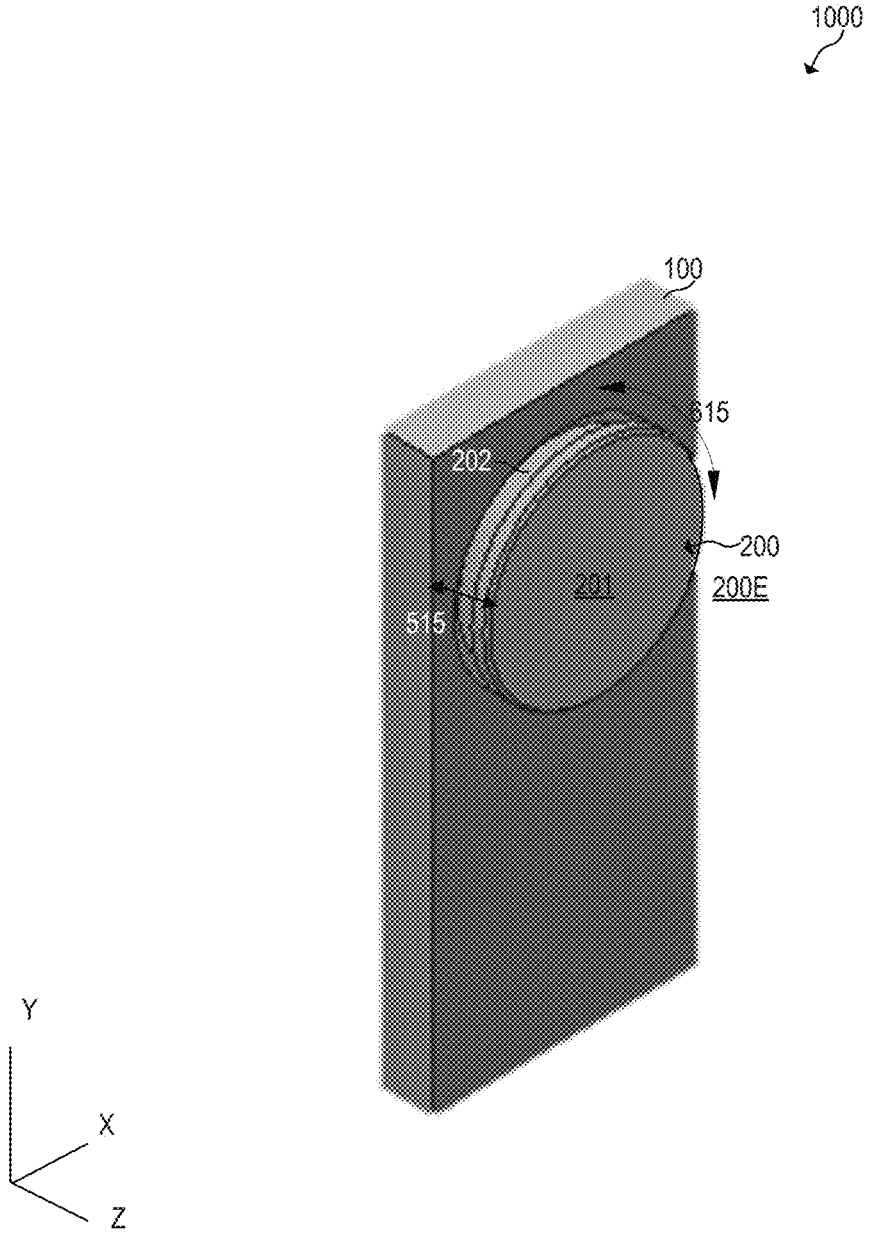
FIG. 1 illustrates a side perspective view of a handle with a retractable knob, according to some examples.

Referring now to the figures, FIG. 1 illustrates a front perspective view of a handle 1000. Handle 1000 comprises a housing 100 and a knob 200. Knob 200 has a first surface 201 and a sidewall 202 that is connected to first surface 201. Knob 200 has a retracted position in which knob 200 is recessed into housing 100 and an extended position in which knob 200 protrudes from housing 100. The movement of knob 200 between the retracted position and the extended position is represented by arrow 515. In the extended position, knob 200 is rotatable between a first position and a second position. This rotational movement is represented by arrow 615. In some examples, the first position may be a position in which handle 1000 is locked and the second position is a position in which handle 1000 is unlocked. In other examples, the first position may be a position in which handle 1000 is unlocked and the second position is a position in which handle 1000 is locked.

In some examples, and as shown in FIG. 1, first surface 201 may be a planar surface such that a majority of first surface 201 exists on a single plane (not accounting for surface irregularities, etc.). In other examples, first surface 201 may be non-planar, such as concave (curved towards the housing 100), convex (curved away from housing 100), or a combination thereof. In some examples, and as shown in the figures, first surface 201 has a circular perimeter. However, first surface 201 may have other perimeters, such as oval, square, rectangular, etc.

Sidewall 202 is connected to first surface 201. As used herein, connected may include examples where sidewall 202 is directly connected to first surface 201 (e.g., sidewall 202 contacts first surface 201) and examples where sidewall 202 is indirectly connected to first surface 201 (e.g., sidewall 202 is directly connected to another surface that is directly connected to first surface 201). In some examples, sidewall 202 is circumferential. As used herein, a circumferential sidewall includes a sidewall that follows the perimeter of first surface 201. For example, when first surface 201 has a circular perimeter, a sidewall 202 that is circumferential may generally look like a circular cylinder. This may be seen in FIG. 1. As another example, when first surface 201 has a square perimeter, a sidewall 202 that is circumferential may generally look like a rectangular prism.

Figure 2:
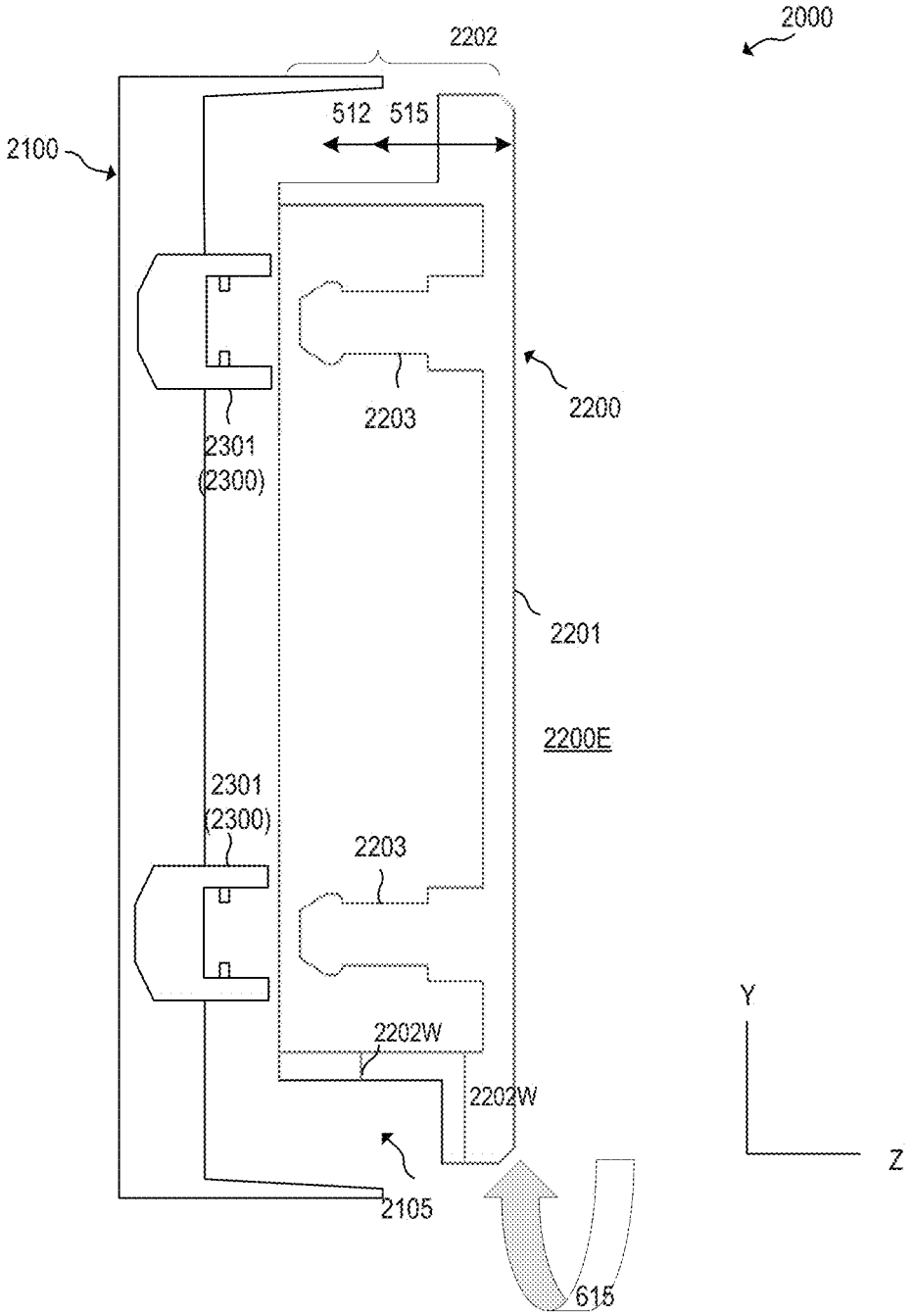
FIG. 2 illustrates a vertical cross sectional view of a handle with a knob and a housing, according to some examples.

The internal space that is captured by first surface 201 and sidewall 202 may be characterized as being an internal environment of knob 200. This is not visible in FIG. 1, but is visible in FIG. 4 of knob 3200, represented by numeral 2001. The space that is not captured by first surface 201 and sidewall 202 may be characterized as being an external environment of knob 200. This is shown in FIG. 1, represented as numeral 200E. This is also shown in FIGS. 2 (2200E) and in FIG. 3 (3200E). Sidewall 202 may have a thickness 202T that is not visible in FIG. 1. The description below in relation to thickness 2202T of FIG. 2 and thickness 4202T of FIG. 4 is applicable to thickness 202T.

In some examples, handle 1000 may be operated in the following manner. First, knob 200 may be moved from the retracted position into the extended position by movement 515. During movement 515, knob 200 is in the first position. While in the extended position, knob 200 may be rotated by movement 615 to move it from the first position to a second position. This rotational movement 615 may be used to operate (e.g., unlock) the handle. To return knob 200 to the retracted position, knob 200 may be rotated by movement 615 to move it from the second position to the first position. In the first position, knob 200 may be moved from the extended position to the retracted position by movement 515. Thus, knob 200 and the interaction of knob 200 with housing 100 allows handle 1000 to have a slim profile while not in operational use. Handle 1000 of FIG. 1 may have some or all of structure aspects of handle 2000 of FIG. 2, knob 3200 of FIGS. 3-4 or/and handle 4000 of FIGS. 5-8.

FIG. 2 shows a vertical cross section of a handle 2000 having a circular knob 2200 and a housing 2100 along the Y-Z plane of the XYZ coordinate system shown in FIG. 1. Housing 2100 may have an opening 2105. Handle 2000 may have a latching mechanism 2300 mounted inside opening 2105. In some examples, and as shown in FIG. 2, latching mechanism 2300 comprises a push-push latch 2301. The circular knob 2200 may have an arm 2203 to engage the push-push latch 2301. In some examples, arm 2203 engages with push-push latch to retain circular knob 2200 in a retracted position inside opening 2105. Arm 2203 disengages push-push latch 2301 to release circular knob 2200 from the retracted position into an extended position. This movement is shown in FIG. 2 as 515. In the extended position, circular knob 2200 is rotatable between a locked position and an unlocked position. This rotational movement is represented by 615

While FIG. 2 shows handle 2000 as having two push-push latches 2301, handle 2000 is not limited by the number of push-push latches shown. For example, handle 2000 may have one push-push latch, three push-push latches, etc. Additionally, while FIG. 2 shows handle 2000 as having two arms 2203, handle 2000 is not limited by the number of arms shown. For example, handle 2000 may have one arm, three arms, etc. In some examples, two push-push latches and two arms may allow for sufficient force to retain knob 2200 in its retracted position inside housing 2100.

As discussed above in reference to knob 200, knob 2200 may also have a first surface 2201, and a sidewall 2202 similar to first surface 200 and sidewall 202. Sidewall 2201 may have a thickness 3202T. In some examples, and as shown in FIG. 2, thickness of sidewall 2202 may vary as sidewall extends from first surface 2201. The thinning of the sidewall 2202 near the portion of where it is retracted into housing 2100 (e.g., near opening 2105) may facilitate the placement of knob 2200 into housing 2100. In other examples, thickness 2202T may gradually vary along thickness of knob 2200 instead of changing abruptly. This is described in relation to FIG. 4.

As used herein, a push-push latch may include a mechanism that retains a first component inside a second component and, upon further depression of the first component into the second component, releases the first component from the second component. The further depression of the first component may be moving the first component further into the second component past the location of where the first component is retained. Thus, for example, if a length of the first component is 10 mm and its retaining position inside the second component is that 1 mm of the first component is visible, a push-push latch mechanism allows for the release of the first component from the second component by pressing the first component further into the second component so that a portion or all of the 1 mm is pushed into the second component. Pushing the remaining 1 mm inside the second component allows the second component to release its hold on the first component.

Thus, in the example of FIG. 2, push-push latch 2301 may have corresponding features (not shown) that grasp arm 2203 to retain knob 2200 in a retracted position in housing 2100. In some examples, in the retracted position, first surface 2201 of knob 2200 may be visible while other elements of knob 2200 (e.g., sidewall 2202) is recessed into opening 2105 of housing 2100. Upon further depression of knob 2200 into housing 2100 from the retracted position, the corresponding features of push-push latch 2301 and arm 2203 may disengage, thus allowing knob 2200 to move to an extended position. The further depression of knob 2200 to move it from its retracted position to its extended position is shown by 512 in FIG. 2. In some examples, the further depression of knob 2200 into housing 2100 is 1 mm or less (e.g., 0.5 mm, 0.25 mm, etc.). Numerous suitable push-push latch mechanisms may be used to implement push-push latch 2301, including but not limited to Anixter Push Lock Door Retaining Catch type 2014200.

In some examples, knob 2200 may be rotated by movement 615 to bring knob 2200 from a first position (e.g., locked position) to a second position (e.g., unlocked position) when it is in the extended position. In some examples, knob 2200 may not be rotated between a first position and a second position when it is in the retracted position. Additionally, in some examples, knob 2200 may be moved from its extended position to its retracted position when it is in a first position (e.g., locked position) and not when it is a second position (e.g., unlocked position). Thus, in some examples, handle 2000 may be operated in a similar manner as described above in reference to handle 1000. Handle 2000 of FIG. 2 may have some or all of structure aspects of handle 1000 of FIG. 1, knob 3200 of FIGS. 3-4 or/and handle 4000 of FIGS. 5-8.

Figure 3:
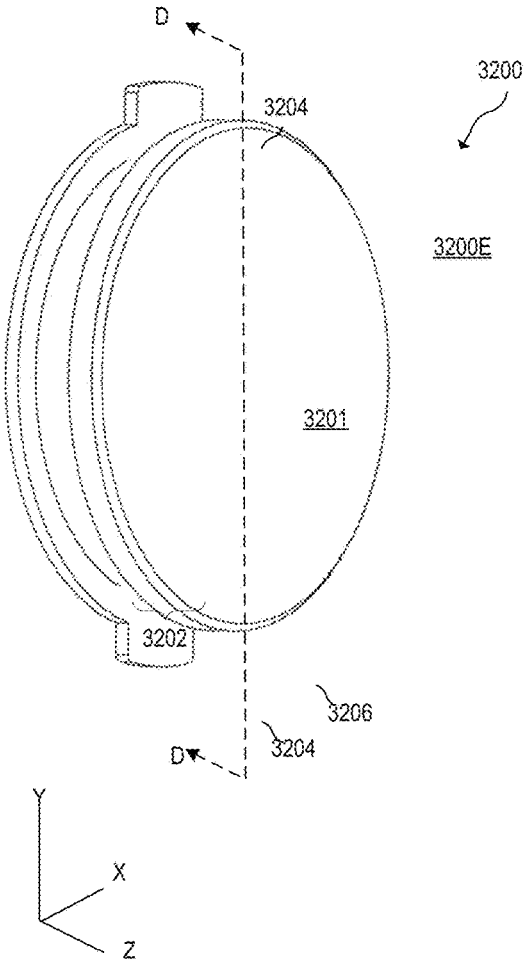
FIG. 3 illustrates a front perspective view of a knob of a handle, according to some examples.
Figure 4:
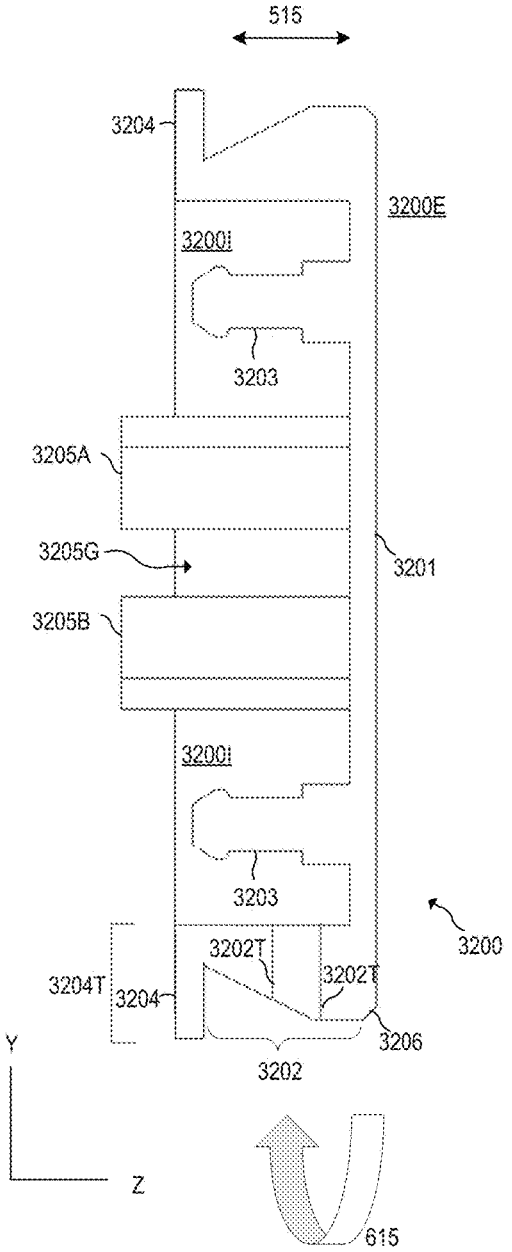
FIG. 4 illustrates a vertical cross sectional view of the knob in FIG. 3 at line D-D, according to some examples.

FIGS. 3 and 4 show a knob 3200. FIG. 3 shows a front perspective view and FIG. 4 shows a vertical cross section along line D-D of FIG. 3 of the Y-Z plane of the XYZ coordinate system shown in FIG. 3.

Similar to knobs 200 and 2200, knob 3200 may have a first surface 3201 and sidewall 3202. Sidewall 3202 may have a thickness 3202T that gradually changes through as knob 3200 progress from first surface 3201 to flange 3204. This gradual change of thickness 3202T may facilitate the movement of knob 3200 into its retracted position. 3200E characterizes an external environment of knob 3200 and 3200I characterizes an internal environment of knob 3200 (i.e., the space that is captured by first surface 3201 and sidewall 3202).

Knob 3200 may include a beveled edge 3206 that is between sidewall 3202 and first surface 3201. This may allow first surface 3201 to protrude above a housing into which knob 3200 is recessed when knob 3200 is retracted into housing. Knob 3200 may also have a flange 3204. Flange 3204 may protrude from sidewall 3202. In some examples, and as shown in FIGS. 3 and 4, flange 3204 has a thickness 3204T that is greater than thickness 3202T of sidewall 3202. This allows flange 3204 to extend beyond sidewall and allows flange 3204 to act as a guide for knob 3200 during rotational movement 615 of knob 3200. While FIGS. 3 and 4 show knob 3200 as having two flanges 3204, handle 3000 is not limited by the number of flanges shown. For example, knob 3200 may have one flange, three flanges, etc.

In the internal environment 3200I of knob 3200, knob 3200 may have an internal sidewall 3205. Internal sidewall 3205 may have a gap 3205G. In some examples, and as shown in FIG. 4, internal sidewall 3205 is comprised of individual sidewalls 3205A and 3205B with gap 3205G between individual internal sidewalls 3205A and 3205B. In some examples, internal sidewall 3205 may include four sidewalls 3205A, 3205B, 3205C, and 3205D with four gaps 3205G between each internal sidewall. In other examples, internal sidewall 3205 may be comprised of one sidewall. In these examples, internal sidewall 3205 may be a continuous cylinder and gap 3205G may be a recessed portion in the cylinder. The gaps 3205G or recessed portion may allow knob 3200 to interact with a lock pinion (not shown in FIG. 4) to operate a latch or bolt on the door. This is described below in relation to FIG. 5. Knob 3200 may also include arm 3203. Arm 3203 is similar as described above in relation to arms 2203. Additionally, knob 3200 of FIGS. 3 and 4 may have some or all of structure aspects of handle 1000 of FIG. 1, handle 2000 of FIG. 2, and handle 4000 of FIGS. 5-8.

Figure 5:
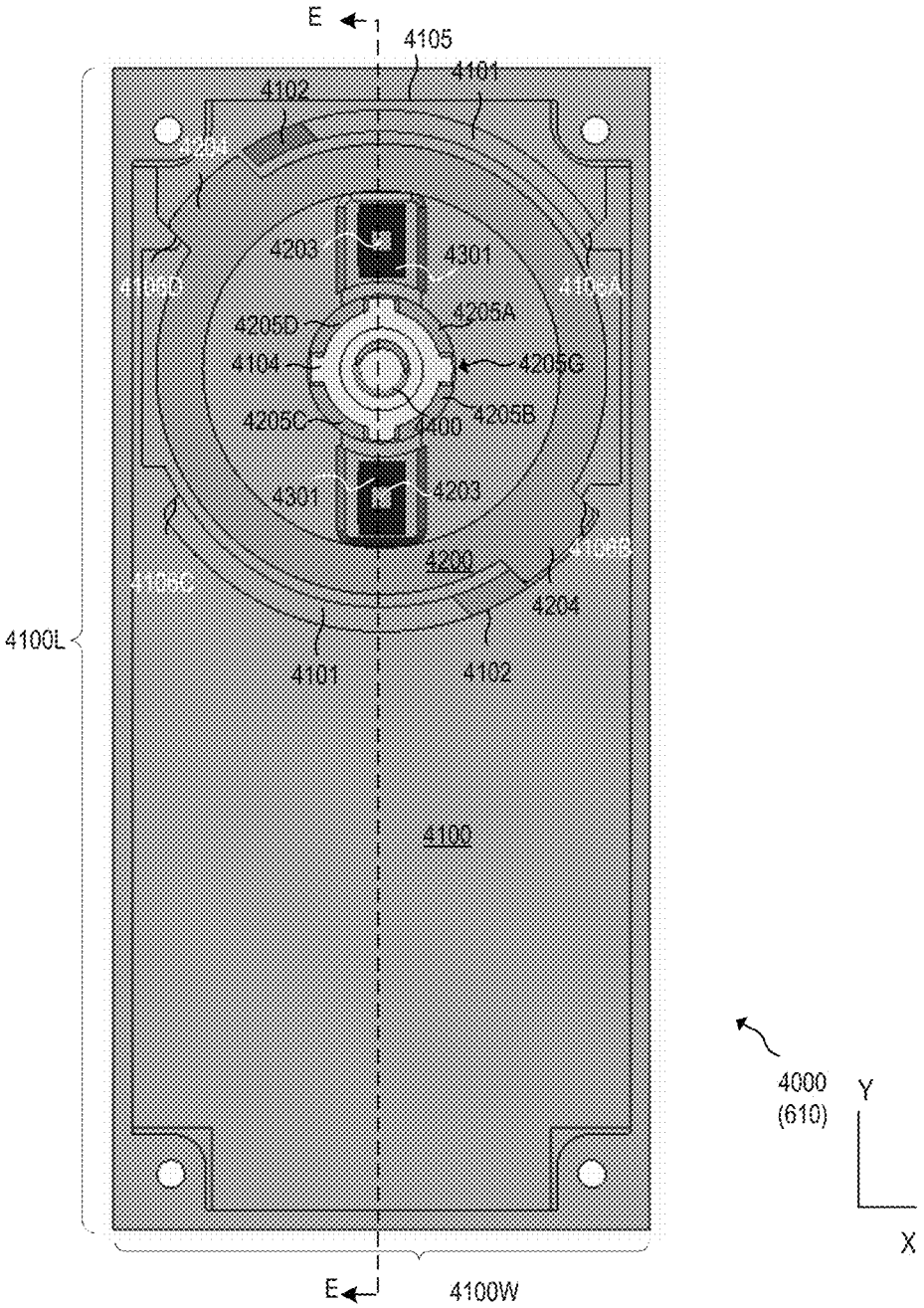
FIG. 5 illustrates a vertical cross sectional view of a handle, according to some examples.

FIG. 5 shows a vertical cross section of a handle 4000 with a knob 4200 and housing 4100 along plane Y-X of the YXZ coordinate shown in FIG. 1. In FIG. 5, handle 4000 (and specifically knob 4200) is in a first position 610 (e.g., locked position). Knob 4200 may include flanges 4204, arms 4203, internal sidewalls 4205A, 4205B, 4205C, 4205D, and gaps 4205G between the internal sidewalls. Housing 4100 may include opening 4105, channels 4101 with sloped portions 4102, stops 4106A, 4106B, 4106C, 4106D, and a lock pinion 4104. Handle 4000 may also include push-push latches 4301 and spring 4400.

These structural aspects of handle 4000 may work together to allow knob 4200 to move from a retracted position in housing 4100 to an extended position. These structural aspects of handle 400 may also allow knob 4200 to rotate from a first position (e.g., locked position) to a second position (e.g., unlocked position) while it is extended position but not while it is in the retracted position. Additionally, these structural aspects may prevent knob 4200 from being moved into the retracted position when it is in the second position.

As will be described in reference to FIG. 6 and FIG. 7, the knob may be in the retracted position when a sidewall of knob 4200 is recessed into housing 4100. The knob 4200 may be in the extended position when a sidewall of knob 4200 protrudes from the housing. In some examples, a first surface of knob 4200 may be level with a second surface of housing 4100 in the retracted position. In other examples, the first surface of knob 4200 may be slightly elevated as compared to the second surface of housing 4100 in the retracted position.

In some examples, housing 4100 is rectangular in shape, having a dimension along the X-axis of 4100W and a dimension along the Y-axis of 4100L. In some examples, width 4100W and length 4100L are based on dimensions used in industry standards. Thus, in some examples, width 4100W is 25 mm and length 4100L is 150 mm. This allows handle 4000 to be installed on computing device rack doors, which may have pre-drilled openings sizes that are 150 mm long and 25 mm wide. In other examples, 4100W and length 4100L have dimensions that are different from industry standards. Additionally, housing 4100 may have other shapes, such as square, oval, or circular shapes.

Opening 4105 of housing 4100 allows knob 4200 to be retracted into housing 4100. In some examples, opening 4105 is similar in size and shape to first surface of knob 4200. First surface of knob 4200 is not shown in FIG. 5 because the vertical cross section of handle 4000 is taken at a location that does not include first surface. The mirroring of opening 4105 of housing 4100 to first surface may allow the internal components of handle 4000 to be hidden from a user and thus not easily tampered with by the user.

Channels 4101 are paths in housing 4100 that guide the rotation of knob 4100 between the first position 610 (shown in FIG. 5) and the second position 620 (not shown in FIG. 5S). Channels 4101 are sized and shaped to fit flanges 4204. Thus, during the rotation of knob 4200 to move the knob 4200, flanges 4204 may move in their rotational path from where they are shown in FIG. 5 to engage with channels 4101.

Stops 4106A, 4106B, 4106C, and 4106D may be protruding components included in housing 4100 that limit the rotation of the knob 4100. In some examples, stops 4106A-D may be trapezoidal pieces that protrude into the rotational pathway of flanges 4204. Once flanges 4204 hit stops 4106A-4106D, flanges 4204 can no longer move. Thus, an angle of rotation of knob 4200 between the first position and the second position may be affected by the location of stops 4106A-D. In some examples, stops 4106A-4106D are placed such that the angle of rotation of knob 4100 between the first position and the second position is 45 degrees. Accordingly, stop 4106A may be located 45 degrees apart from stop 4106C and stop 4106D may be located 45 degrees apart from stop 4106B. In other examples, the angle of rotation of knob 4100 is 90 degrees. In these examples, stop 4106A may be located 90 degrees apart from stop 4106C and stop 4106D may be located 90 degrees apart from stop 4106B. In some examples, the location of stops 4106A, 4106B, 4106C, and 4106D is proportional to an amount that it takes to move a bolt or latch to operate a door.

As discussed above, channels 4101 may include sloped portions 4102. These sloped portions may prevent knob 4100 from being retracted into housing 4100 (or moved into the retracted position) when the flanges 4204 are at certain locations in channels 4101.

For example, as shown in FIG. 5, flanges 4204 are not yet engaged with channels 4101. Thus, the location of flanges 4204 in channels 4101 as shown in FIG. 5 allows the knob 4200 to be moved into the retracted position. A clockwise rotational movement of knob 4200 will move one flange away from stop 4106D towards stop 4106A and another flange away from stop 4106B towards stop 4106C. While the flanges are being moved along their rotational pathways, flanges engage with 4101, first encountering sloped portions 4102. In some examples, the sloped portion 4102 between stops 4106D and 4106A increases from a low height to a maximum height progressing in a clockwise direction from 4106D to 4106A. Similarly, the sloped portion 4102 between stops 4106B and 4106C increases from a low height to a maximum height progressing in a clockwise direction from 4106B to 4106C. In some examples, the maximum height is such that knob 4200 is prevented from moving into the housing 4100 but is not protruded further out of the housing 4100 past the extended position.

Accordingly, the space in housing 4100 at which the flanges 4204 reside as shown in FIG. 5 is deep enough to allow knob 4200 to be moved into the retraced position. However, when flanges 4204 encounter channels 4101 along their rotational path, the sloped portion 4102 and channels 4101 prevent downward movement of flanges 4204. This prevents knob 4200 from being moved into its retracted position when the knob 4200 is in the second position (e.g., unlocked position).

Lock pinion 4104 may interact with gaps 4205G between internal sidewalls 4205A-4205D to interlock with internal sidewalls 4205A-4205D. For example, lock pinion 4104 may have protrusions that fit into gaps 4205G and knob 4200 may be placed in housing 4100 such that the protrusions are inserted into gaps 4205G of internal sidewall 4205. Lock pinion 4400 may interact with a latch or bolt (not shown). Internal sidewalls 4205A-4205D may be connected to a first surface of knob 4200. Thus, due to the interaction of lock pinion 4104 with gaps 4205G, a rotation of knob 4200 rotates internal sidewalls 4205A, which in turn rotates lock pinion 4104. Lock pinion 4104 is then able to move a latch or bolt to operate the handle 4000.

Additional details of handle 4000 will be discussed below in reference to FIGS. 6 and 7. FIGS. 6 and 7 show vertical cross sectional views of handle 4000 along line E-E of FIG. 5 along the YZ plane. In FIG. 6, handle 4000 is in retracted position 510 and in the first position 610. In FIG. 7, handle 4000 is in the extended position 520 and in the first position 610.

Figure 6:
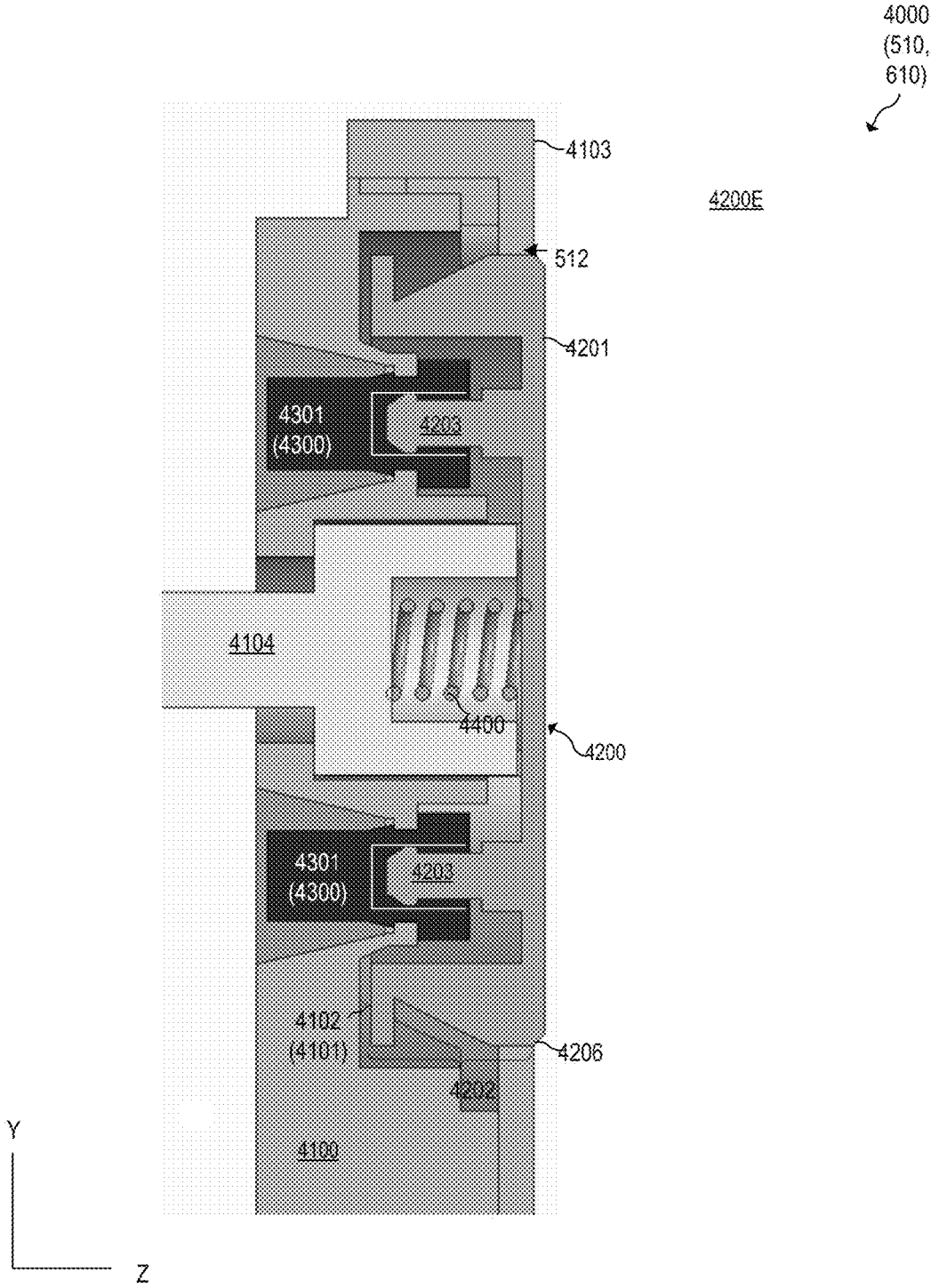
FIG. 6 illustrates a vertical cross sectional view of the handle in FIG. 5 at line E-E in a retracted position, according to some examples.

FIG. 6 shows the second surface 4103 of housing 4100 that was discussed above. Second surface 4103 is a surface of housing 4100 that faces a user of handle 4000. For example, when handle 4100 is mounted on a door, second surface 4103 of housing 4100 is the side of housing 4100 that faces the user.

In some examples, and as shown in FIG. 6, when handle 4100 is in the retracted position 510, first surface 4201 of knob 4200 is not level with second surface 4103. Instead, first surface 4201 is elevated with regard to second surface 4103. Additionally, a beveled edge 4206 that is connected to first surface 4201 and sidewall 4202 protrudes from the housing 4100. Beveled edge 4206 may act as a feature on knob 4200 to indicate to a user of handle 4200 the placement of knob 4200 so that the user knows to interact with handle 4000. In some examples, beveled edge 4206 may have a different texture or paint gloss than other portions of handle 4000 so that beveled edge 4206 is easily recognizable by a user of handle 4000. In other examples, and not shown in FIG. 6, first surface 4201 is level with second surface 4103 when knob 4200 is in the retracted position 510. In some examples, in the retracted position 510, sidewall 4202 of knob 4200 is recessed into housing 4100 and is not visible to an external environment 4200E of handle 4000.

As seen in FIG. 6, knob 4200 does not interact with channel 4101 or sloped portion 4102 of channel when in the retracted position 510. The curve of sloped portion 4105 is visible in the vertical cross sectional view provided by FIG. 6.

When knob 4200 is in the retracted position, arms 4203 engage with latch mechanisms 4300 to retain knob 4200 in the retracted position 510. In some examples, and as discussed above in relation to FIG. 2 and FIG. 6, latch mechanisms 4300 may comprise push-push latches 4301. In examples where latch mechanisms 4300 comprise push-push latches 4301, knob 4200 is further depressed or moved into housing 4100 to move knob 4200 from the retracted position 510 shown in FIG. 6 to the extended position shown in FIG. 7. The further movement of knob 4200 into housing 4100 is shown by 512. The further movement 515 allows arms 4203 to disengage from push-push latches 4301 and allows knob 4200 to move from the retracted position 510 to the extended position 520.

In some examples, and as shown in FIG. 6, knob 4200 may be biased towards the extended position 520 by a spring 4400. Spring 4400 may sit in a center space in lock pinion 4104 and internal sidewall 4105 (not visible in FIG. 6). Upon disengagement of arms 4203 from push-push latches 4301, spring 4400 extends from its compressed position and biases the knob 4200 into the extended position 520. While FIG. 6 shows a coiled spring 4400, other types of biasing mechanisms may be used, including but not limited to wave springs, leaf spring, etc. In some examples, an amount that beveled edge 4206 protrudes out from the housing 4100 in the handle's retracted position is similar to an amount that knob 4200 is depressed further into housing 4100 to move knob 4200 from the retracted position 510 to the extended position 520.

Figure 7:
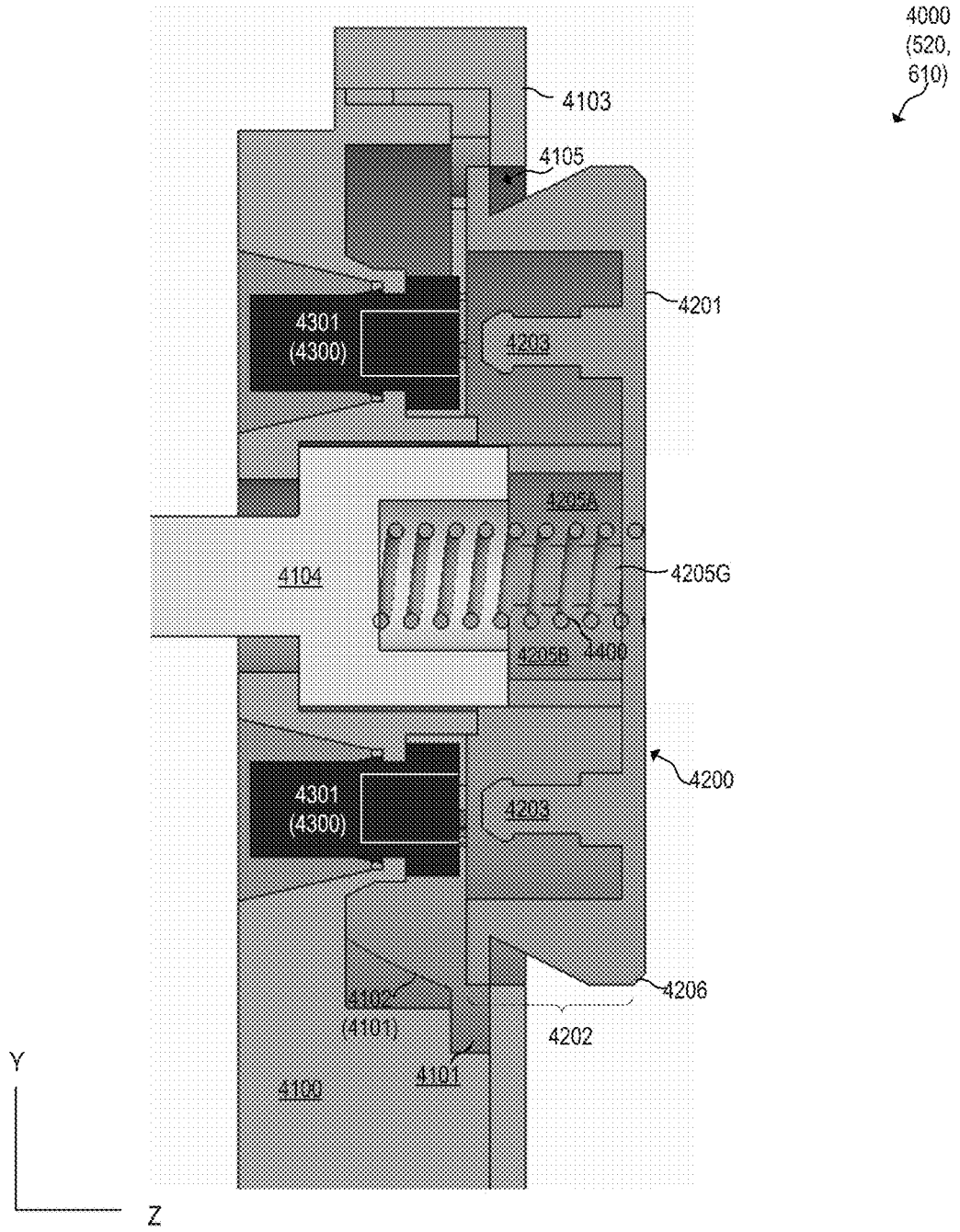
FIG. 7 illustrates a vertical cross sectional view of the handle in FIG. 5 at line E-E in an extended position, according to some examples.

FIG. 7 shows handle 4000 in the extended position 520 and first position 610 (e.g., locked position). As shown in FIG. 7, in the extended position 520, a portion of sidewall 4202 extends outside of housing 4100. Although FIG. 7 shows that a portion and not an entirety of sidewall 4202 extends outside of housing 4100, in other examples, an entirety of sidewall 4202 may extend outside of housing 4100 in the extended position 520. Arms 4203 are disengaged from push-push latches 4301 and spring 4400 is extended from its compression (seen in FIG. 6.). Also visible in FIG. 7 are internal sidewalls 4205A and 4205B with gap 4205G.

As seen in FIGS. 6 and 7, when knob 4200 is in the first position 610, knob 4200 is not engaged with channel 4101 or sloped portion 4102 of channel 4101 because flanges 4204 have not been moved in their rotational path towards channel 4101. This allows knob 4200 to be moved from the retracted position 510 to the extended position 520 and from the extended position 520 to the retracted position 510.

Figure 8:
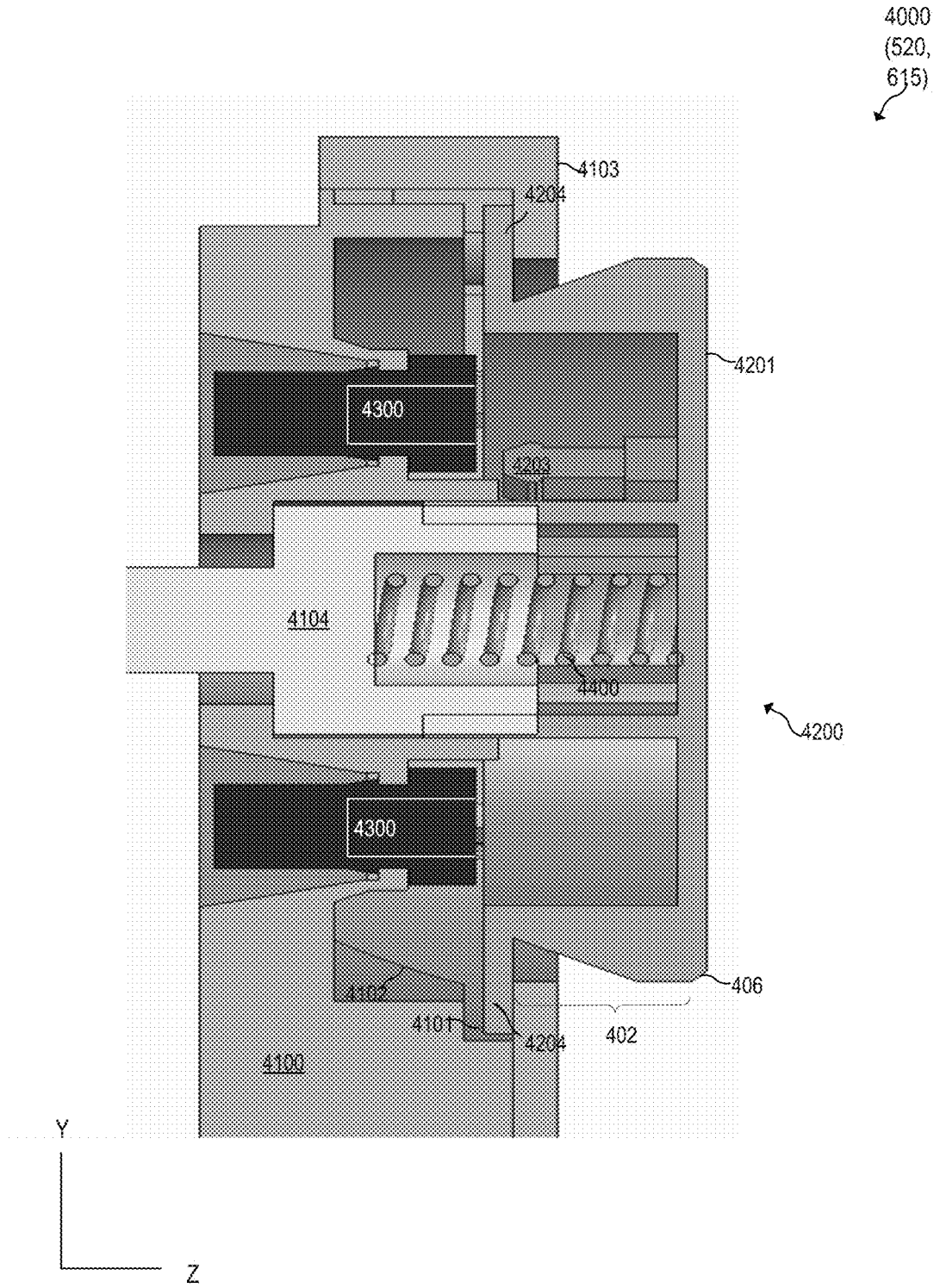
FIG. 8 illustrates a vertical cross sectional view of the handle at FIG. 5 at line E-E, in a position that is rotated from the position shown in FIG. 5, according to some examples.

FIG. 8 shows a vertical cross-sectional view of handle 4000 at line E-E of FIG. 5 along the YZ plane. However, FIG. 8 shows the knob 4200 (and specifically flanges 4204) rotated clockwise from their rotational position of FIG. 5 such that each flange is bisected by line E-E of FIG. 5.

In this position, knob 4200 is in the rotational motion 615 of being moved from the first position 610 to the second position 620. As seen in FIG. 8, flanges 4204 are engaged with channels 4101 such that channels 4101 prevents knob

4200 from being moved into the retracted position 510. An edge of the sloped channel of portion 4102 is visible in this vertical cross-sectional view. It appears curved because of the curved aspect of the knob. As shown in FIG. 8, knob 4200 cannot move into the retracted position 510 while it is being moved along its rotation path 615 towards the second position 620 and when it arrives at the second position 620 due to channels 4101 and sloped portions 4202. Handle 4000 of FIGS. 5, 6, 7, and 8 may have some or all of structure aspects of handle 1000 of FIG. 1, handle 2000 of FIG. 2, and/or knob 3200 of FIGS. 3-4.

Figure 9:
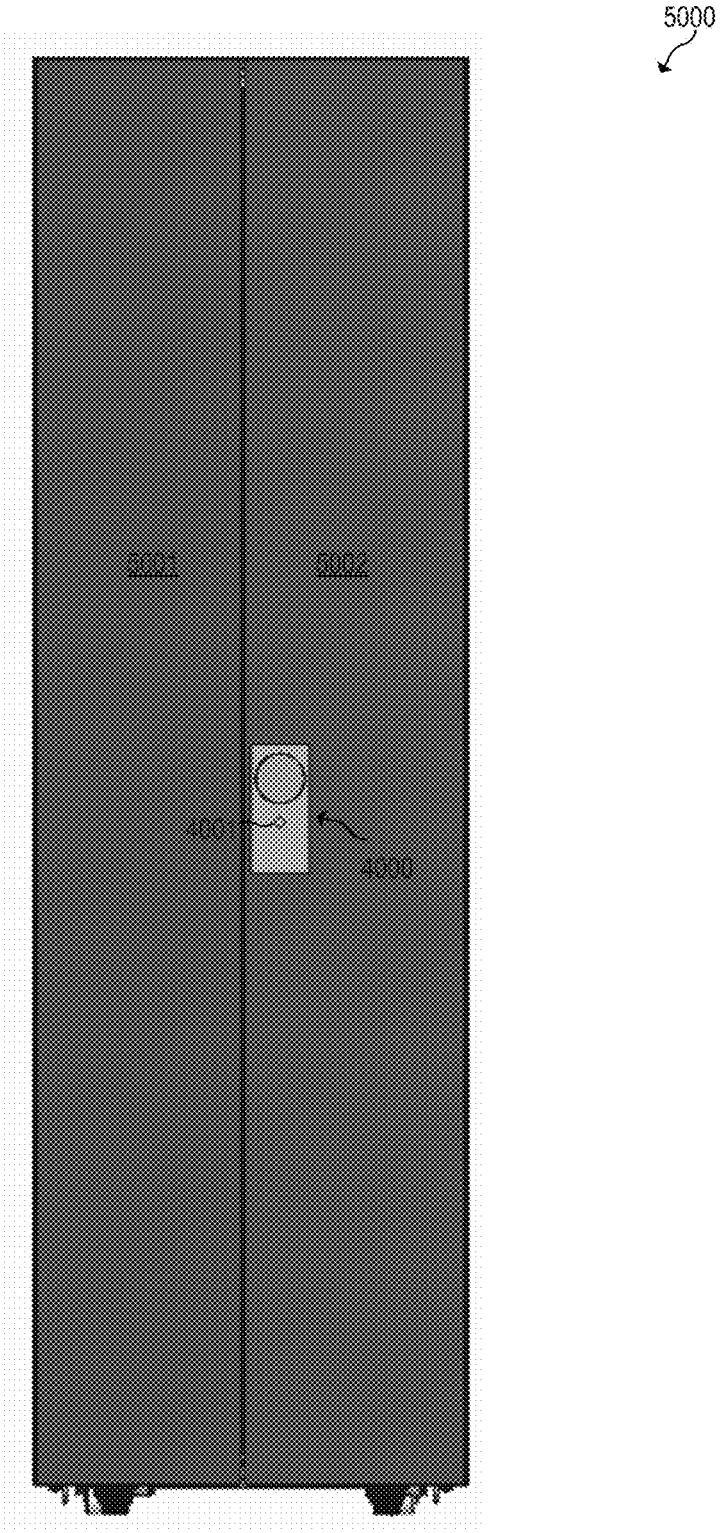
FIG. 9 illustrates the handle of FIG. 5 installed on a server rack, according to some examples.

FIG. 9 shows an illustration of a computing device rack 5000 (e.g., a server rack, etc.) with doors 5001 and 5002. Handle 4000 is installed on door 5002. In some examples, handle 4000 may comprise a keyhole 4001 that prevents the operation of the lock pinion such that rack 5000 cannot be accessed. For example, the key hole may prevent the rotation of knob 4200 from the first position to the second position.

FIGS. 10A-10H illustrate an operation of handle 4000 on computing device rack 5000. At FIG. 10A, handle 4000 is in the retracted position 510 and the first position 610. In some examples, the first position 610 may be a position where the handle is locked and the rack door 5002 cannot be opened. At FIG. 10B, the knob 4200 of handle 4000 is depressed (i.e. moved) further into housing 4100 from its position in FIG. 10A. This movement is represented by 512. Movement 512 may release arms 4203 from push-push latches 4301 and allow spring 4400 to bias knob 4200 towards the extended position 520.

Figure 10A:
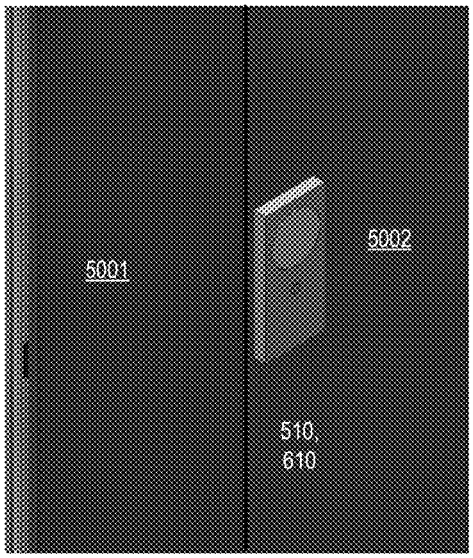
FIG. 10A illustrates the operation of the handle of FIG. 9, according to some examples.
Figure 10B:
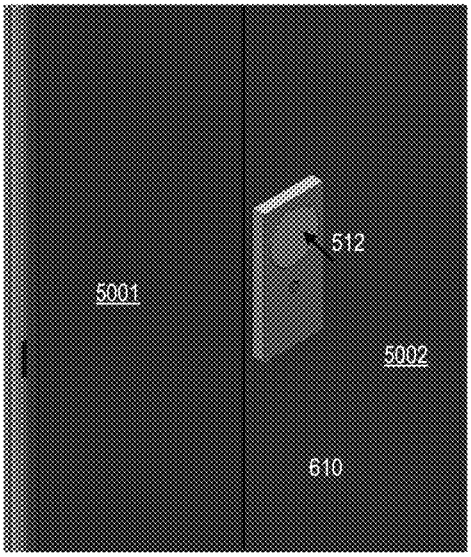
FIG. 10B illustrates the operation of the handle of FIG. 9, according to some examples.
Figure 10C:
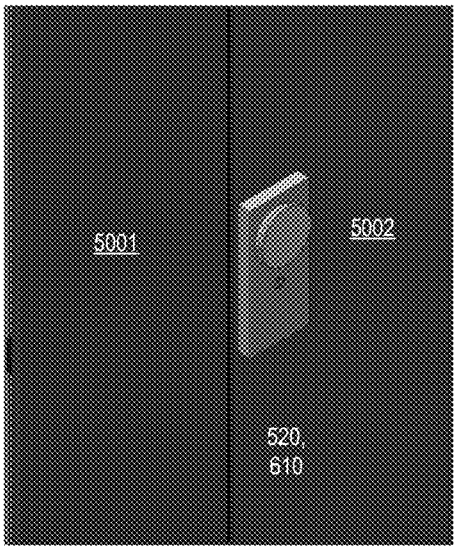
FIG. 10C illustrates the operation of the handle of FIG. 9, according to some examples.
Figure 10D:
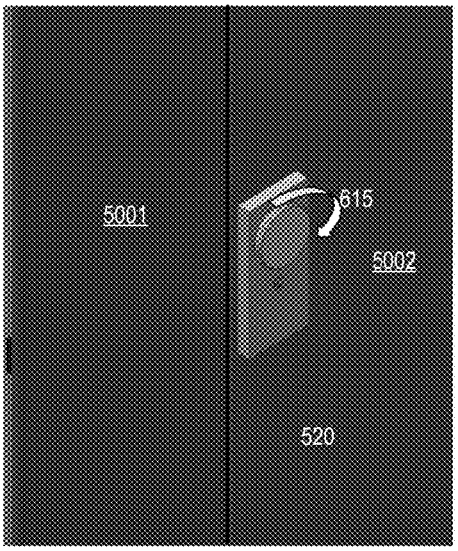
FIG. 10D illustrates the operation of the handle of FIG. 9, according to some examples.
Figure 10E:
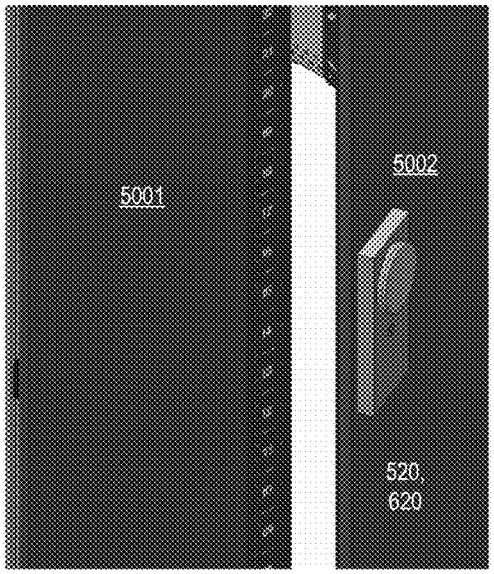
FIG. 10E illustrates the operation of the handle of FIG. 9, according to some examples.

At FIG. 10C, the knob 4200 is in an extended position 520 and a first position 610 (e.g., locked position). At FIG. 10D, knob 4200 is rotated clockwise from the first position 610 towards the second position 620. This rotational movement is represented by 615. At FIG. 10E, knob 4200 is in the extended position 520 and in the second position 620. In the example of FIG. 10E, the second position 620 represents an unlocked position where door 5002 of rack 5000 may be moved towards or away from door 5001. In FIG. 10E, knob 4200 cannot move into the retracted position 510 due to the interaction of flanges 4204 with channel 4101.

Figure 10F:
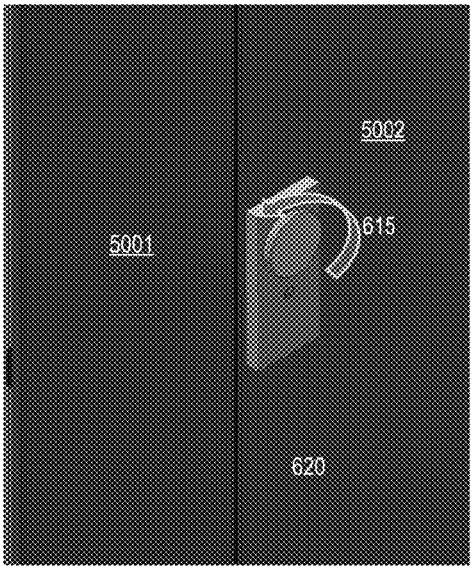
FIG. 10F illustrates the operation of the handle of FIG. 9, according to some examples.
Figure 10G:
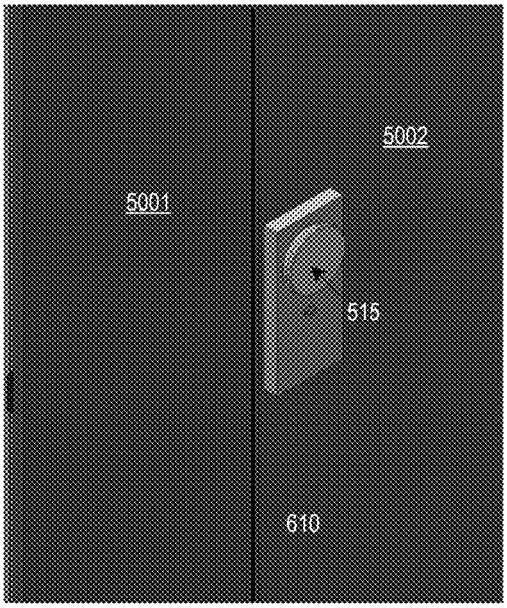
FIG. 10G illustrates the operation of the handle of FIG. 9, according to some examples.
Figure 10H:
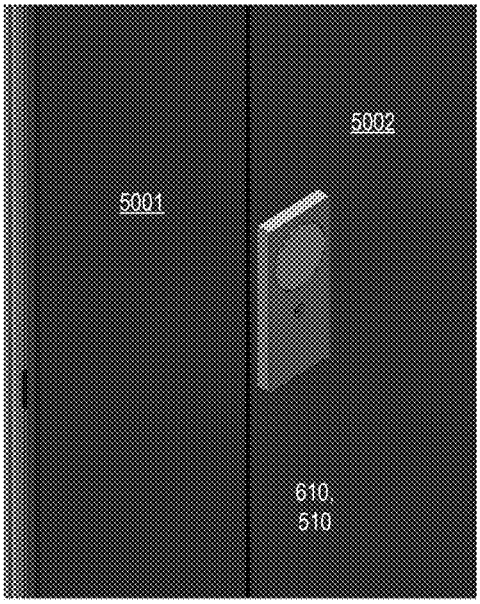
FIG. 10H illustrates the operation of the handle of FIG. 9, according to some examples.

At FIG. 10F, knob 4200 is in the second position 620. Knob 4200 is rotated counter-clockwise from second position 620 towards first position 610. This rotational movement is represented by arrow 615. At FIG. 10G, knob 4200 is in the first position 610. Knob 4200 may be moved into the retracted position because flanges 4204 no longer engage with channel 4101. This movement is represented by arrow 515. At FIG. 10H, knob 4200 is in the first position 610 and the retracted position 510. While some examples described herein may refer to the first position 610 as a locked position and the second position 620 as the unlocked position, in other examples, the first position may be the unlocked position of the handle and the second position may be the locked position of the handle.

Handle 1000, handle 2000, knob 3200, and handle 4000 may be comprised of durable materials, including but not limited to different types of metals, thermoplastic polymers, such as polycarbonate and polycarbonate alloys (e.g., PC-ABS, Lexan, etc.), etc.

All of the features disclosed in this specification (including any accompanying claims, abstract and drawings), and/or all of the elements of any method or process so disclosed, may be combined in any combination, except combinations where at least some of such features and/or elements are mutually exclusive.

What is claimed is:

1. A door handle comprising:
a housing with an opening and a sloped channel; and
a push-push latch mounted inside the opening;
a circular knob with a flange, a flat surface, a beveled edge, and an arm to engage the push-push latch;
wherein the arm engages the push-push latch to retain the circular knob in a retracted position in the opening;
wherein the arm disengages the push-push latch to release the circular knob from the retracted position to an extended position;
wherein, in the retracted position, the push-push latch prevents rotation of the circular knob;
wherein, in the extended position, the circular knob is rotatable between a locked position and an unlocked position;
wherein the rotation of the circular knob between the locked position and the unlocked position moves the flange in the sloped channel;
wherein the housing comprises a sloped channel;
wherein the circular knob comprises a flat surface, a beveled edge, and a flange;
wherein the rotation of the circular knob between the locked position and the unlocked position moves the flange in the sloped channel; and
wherein the opening comprises a number of rotational stops located in the sloped channel to block movement of the flange in the sloped channel.

2. The handle of claim 1, wherein an angle of rotation of the circular knob between the locked position and the unlocked position is at least forty-five degrees.

3. The handle of claim 1, wherein, in the unlocked position, the flange interacts with the sloped channel to retain the circular knob in the extended position.

4. The handle of claim 1, comprising a spring to bias the circular knob to the extended position upon disengagement of the arm from the push-push latch.

5. The handle of claim 1, wherein the housing has a length of 150 mm and a width of 25 mm.

6. A computing device rack handle comprising:
a rectangular panel with an opening;
a push-push mechanism mounted in the circular opening; and
a circular knob having a first surface and a sidewall connected to the first surface;
wherein the circular knob has a retracted position and an extended position;
wherein, in the retracted position, the sidewall is recessed into the circular opening and the knob is not rotatable;
wherein, in the extended position, the sidewall protrudes from the opening and the circular knob is rotatable between a locked position and an unlocked position;
wherein the circular knob comprises an arm to engage with the push-push mechanism to retain the circular knob in the retracted position; and,
wherein the circular knob comprises a beveled surface connected to the first surface and the sidewall, wherein in the retracted position, the beveled surface protrudes from the circular opening.

7. The computing device rack handle of claim 6, wherein the rectangular panel has a length of 150 mm and a width of 25 mm.

8. The computing device rack handle of claim 6, wherein an angle of rotation of the circular knob between the locked position and the unlocked position is at least forty five degrees.

* * * * *